United States Patent [19]

Rosenbaum

[11] 3,998,003

[45] Dec. 21, 1976

[54] CONSTRUCTION TOY DEVICE

[76] Inventor: Sheldon Rosenbaum, 147-03 71st Ave., Flushing, N.Y. 11367

[22] Filed: Dec. 22, 1975

[21] Appl. No.: 643,198

[52] U.S. Cl. ..... 46/25; 46/26; 35/18 A

[51] Int. Cl.[2] ..... A63H 33/08

[58] Field of Search ..... 35/18 A, 34; 46/16, 46/23, 25, 26

[56] References Cited

UNITED STATES PATENTS

| | | | |
|---|---|---|---|
| 2,709,318 | 5/1955 | Benjamin | 46/26 |
| 3,355,820 | 12/1967 | Brumlik | 35/18 A |

*Primary Examiner*—G.E. McNeill
*Assistant Examiner*—Robert F. Cutting

[57] ABSTRACT

The present invention is directed to an educational toy device adapted to the building of three dimensional constructions, which constructions, as a principal subcomponent, are based upon the configuration of an equilateral triangle. The device is characterized by a plurality of strut members of equal length and a plurality of linking members arranged to receive the ends of the strut members, the linking members being essentially spherical and formed of an elastomeric, yieldable, high friction material. The linking members include a plurality of radially extending sockets so constructed and arranged as to permit the end portions of struts to be supported therein while allowing the struts to be moved angularly relatively to each other.

8 Claims, 5 Drawing Figures

FIG. 1
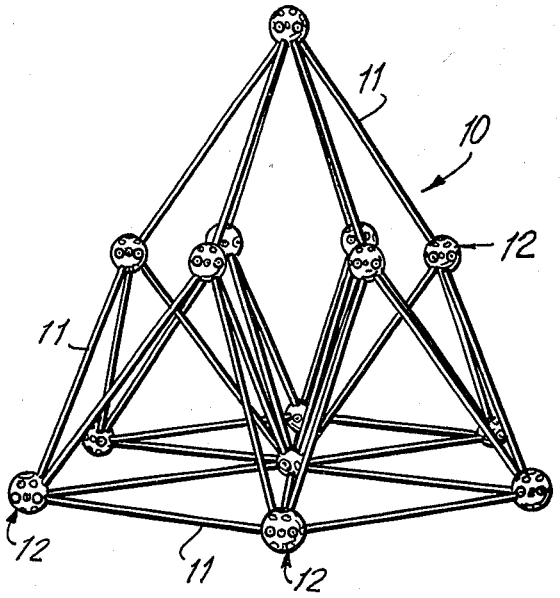
FIG. 2
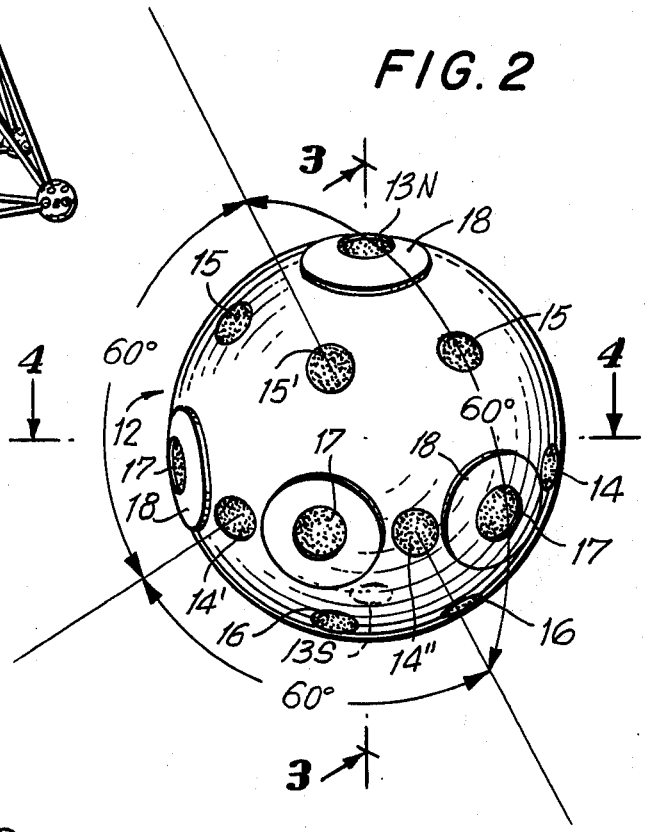
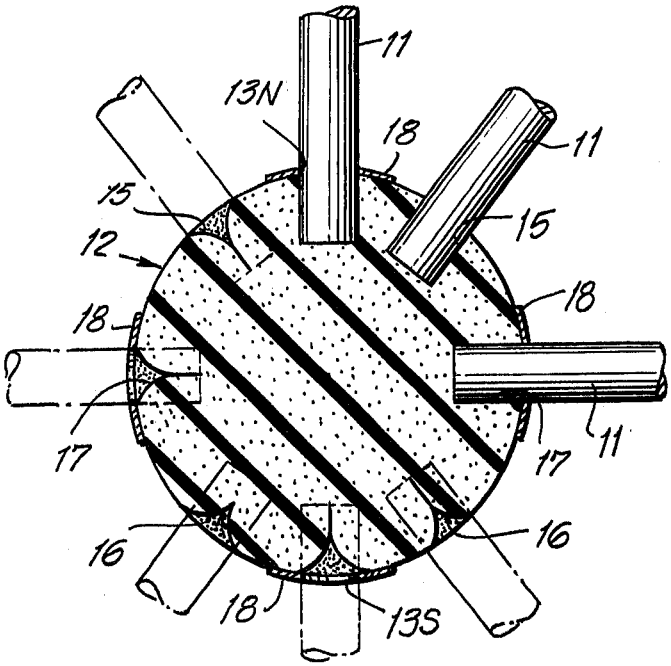
FIG. 3

CONSTRUCTION TOY DEVICE

BACKGROUND OF THE INVENTION

1. Field of the Invention

The present invention is in the field of construction toy devices.

2. The Prior Art

Various toy construction devices are known including struts and members for supporting the ends of the struts in such manner as to permit a multiplicity of struts to be interlocked to form geometric, three dimensional shapes. The joining devices for supporting the struts typically include disks, etc. of rigid material, within which are formed sockets wherein the struts may be supported.

The utility and ability to construct a wide variety of different three dimensional forms has been restricted, by and large, in such devices by their inflexibility and their reliance upon geometric shapes which are essentially rectangular. Additionally, the connection between the struts and joining devices has been found to loosen after a few uses.

SUMMARY

The present invention may be summarized as relating to an improved construction toy device which permits fabrication of an infinite variety of three dimensional geometric shapes. The device is characterized by its reliance upon interlocked equilateral triangles arrayed in different planes as the elementary constructional configuration, and by the use of yieldable, resilient connector members for linking the end portions of the struts, whereby the builder is not restricted to a specific angular orientation between supported struts but, rather, a degree of warping or deformation is permitted, enabling the user to display greater originality and ingenuity than is the case with construction toys heretofore known.

More particularly, and in its preferred form, the linking members for supporting the end portions of the struts are comprised of spheres of cellular material, preferably elastomeric, e.g. sponge rubber balls. The spheres include a plurality of spaced, radially directed conical or cylindrical holes defining sockets for frictionally gripping the end portions of the struts, whereby when a strut is inserted in a respective socket, a degree of angular movement of the strut relative to the ball is permitted without sacrificing the anchoring force of the socket on the strut end.

The sockets are preferably arrayed relative to the sphere in a manner more fully defined hereinafter, to permit struts to be inserted in patterns whereby, through the use of a plurality of balls and struts, a multiplicity of equilateral plane triangles may be formed and linked by additional struts into a three dimensional structure.

The balls or linking members may include, in addition to the sockets intended for the formation of equilateral triangles, other sockets, the principal purpose of which is to support struts which link adjacent structures into an integrated three dimensional unit.

Accordingly, it is an object of the invention to provide an improved construction toy device for forming three dimensional configurations or designs.

A further object of the invention is the provision of a device of the type described including struts and connecting members for engaging the ends of the struts, the connector members being characterized by their being formed of a resilient, yieldable material such as sponge rubber, the rubber incorporating radially directed sockets for the reception of the end portions of the struts.

A further object of the invention is the provision of a construction toy of the type described wherein the angularity between struts supported by a given connecting or linking member may be modified by reasons of the deformable nature of the linking member, without loss of gripping power on the struts.

Still a further object of the invention is the provision of a device of the type described wherein the sockets for supporting the struts are arranged in such manner as to permit the fabrication of three dimensional constructions, based upon the principle of a linking of a multiplicity of equilateral triangles.

To attain these objects and such further objects as may appear herein or be hereinafter pointed out, reference is made to the accompanying drawings, forming a part hereof, in which:

FIG. 1 is a perspective view of a construction fabricated from a device in accordance with the invention;

FIG. 2 is a magnified perspective view of an individual linking member;

FIG. 3 is a section taken on the line 3—3 of FIG. 2;

Figure 4:
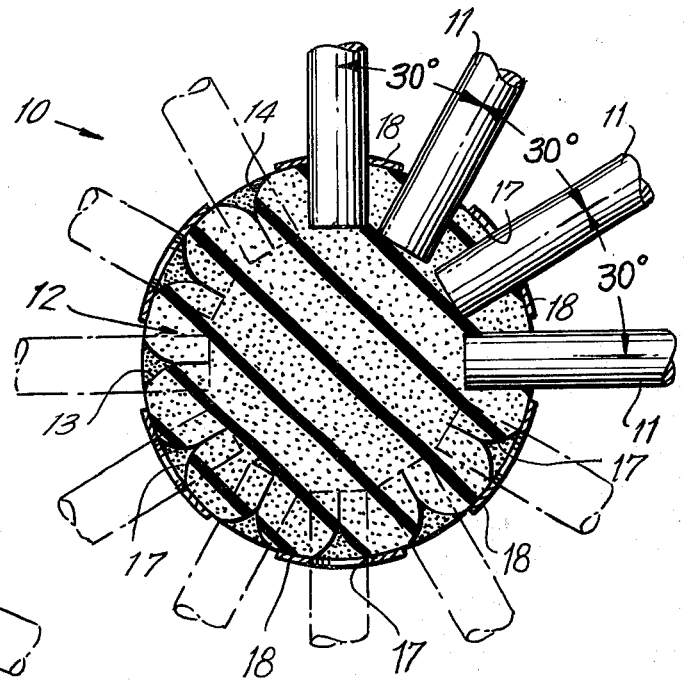
FIG. 4 is a section taken on the line 4—4 of FIG. 2.

Referring now to the drawings, there is shown in FIG. 1, by way of example and without limitation, a three dimensional structure 10 of geometric nature which has been created through the use of the device hereinafter described. The components of which the structure is comprised include a multiplicity of strut members 11 and linking members 12.

The struts 11 preferably comprise elongated rods or dowels which may be made of wood, aluminum, plastic or the like and may be circular, square, etc. in transverse section. The struts 11 are rigid and form, in effect, spacers separating the linking members 12.

The linking members 12, which are preferably spherical and which form a principal feature of the invention, are formed of materials which are elastic, resilient, and have a high coefficient of friction. A preferred material for the linking members is sponge rubber or a like elastomer.

Figure 5:
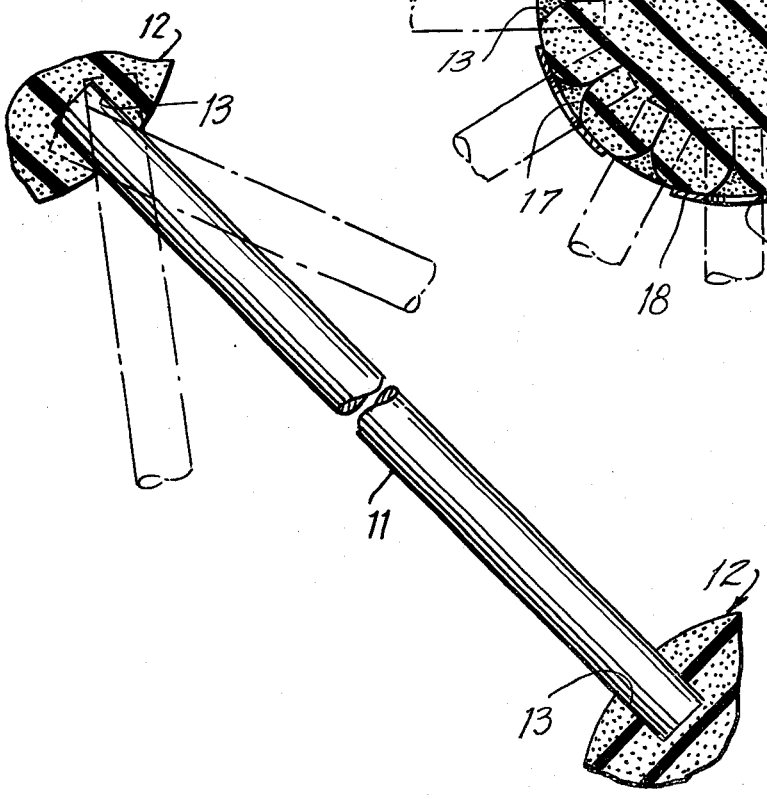
FIG. 5 is a sectional view of a strut extending between adjacent linking members.

The linking members 12 are provided with a multiplicity of radially extending sockets 13 which function frictionally to receive the distal end portions of the struts 11. The sockets, by way of example, may constitute cylindrical or conical depressions in the surface of the spherical linking members, which depressions are of a lesser diameter than the diameter of the struts so as to form, when a strut is inserted into a socket (see FIG. 5) a tight frictional connection which nonetheless permits a degree of tilting movement of the strut relative to the linking member as a result of the yieldable nature of the sponge material. (Compare solid to dot and dash views, FIG. 5). Where the sockets are conical, the base of the cone, at the surface of the sphere, may be larger than the diameter of the strut, facilitating insertion.

An important feature of the invention lies in the positioning of the sockets 13 relative to the linking members, which positioning permits the construction of geometric, three dimensional figures based primarily upon equilateral triangles formed into four sided equilateral pyramids.

In accordance with the preferred embodiment illustrated, each linking member 12 is provided with twenty six sockets. For convenience of description, the spherical linking members 12 and the position of the sockets relative thereto will be referred to utilizing terminology appropriate to the description of a globe, e.g. equator, poles, etc.

Each linking member includes upper and lower sockets at the pole portions, which sockets are referred to as 13N and 13S. At a position corresponding to the equator or great circle bisecting the axis running between the poles, the linking member includes a first series of triangle forming sockets 14, six in number, equally spaced, e.g. separated by an angle of 60°, and lying on the equator. Second and third series of sockets 15, 16, respectively, are disposed between the equator and the North Pole, and the equator and the South Pole, 13N and 13S, respectively.

The six sockets of the second series 15 are located at a position which is 60° offset from an adjacent pair of sockets 14 of the first series, i.e. the sockets 15 are located such that a strut inserted into a socket, e.g. 15', will describe with struts similarly extending from sockets 14' and 14'' an angle of 60°.

In similar fashion, the sockets 16 of the third series are disposed between the equator and the South Pole, each third series socket being offset by 60° from two adjacent sockets, e.g. 14' and 14'' of the first series.

It will be observed from an inspection of FIG. 3 that the sockets of the second and third series, respectively, lay on small circles at a latitude of about 50° from the equator. It will be further apparent that the six sockets of each of the second and third series 15 and 16, respectively, are offset from the other adjacent sockets of the same series by angles of 60°.

Likewise it will be apparent that each socket of the second and third series lies on a great circle extending through the poles, each such great circle being halfway between (30° offset from) the great circles extending through the poles and an adjacent pair of sockets of the first series.

The linking member 12 is provided with a further, fourth series of sockets 17, the sockets 17 being six in number and being located on the equator halfway between the sockets of the first series.

From the foregoing description, it will be apparent that a system of equilateral triangles may be built and that only those sockets of the first, second and third series enter into the formation of the noted equilateral triangles.

Specifically, and with reference to a given linking member, struts may be mounted either in two adjacent sockets of the first series and the intermediate socket of either the second or third series, and the thus mounted struts will bear an angular relation each to the other of 60°. Alternatively, struts may be mounted in two adjacent sockets of the second series or the third series and the intermediate socket of the first series, in which case the thus positioned struts will likewise be angularly oriented at 60° each to the other.

It will further be apparent, with reference to FIG. 1 for instance, that if the three ends of the three thus mounted struts are inserted into sockets of similar linking members, that three additional struts may be mounted between the last mentioned three linking members, whereby there is defined a four sided pyramid, each face of which comprises an equilateral triangle. It will thus be observed that the basic structural form from whih an infinite variety of additional structures may be created is the equilateral pyramid and that the construction of such pyramid involves the use of six struts and four linking members.

Preferably, in order to expedite construction, the sockets not susceptible of forming equilateral triangles, namely the sockets 17 of the fourth series and the sockets 13N and 13S at the poles, are provided with surrounding markings or indicia 18, whereby the builder is able immediately to distinguish the sockets not capable of forming equilateral structures from the others.

The sockets 17 of the fourth series and the pole sockets are employed principally to enable adjacent pyramids, formed as described, to be linked together by the struts which extend between linking members forming a part of two adjacent units. It will be appreciated that the sockets of the first, second and third series may also be employed as the component of linking systems.

An important feature of the invention distinguishing it from construction toys heretofore known lines in the ability of the struts, when mounted in the linking members, to be angularly oriented or articulated relative to each other and to the linking members, the ability to articulate being the result of the elastic, resilient nature of the linking members.

In other construction devices wherein such deflection of the struts relative to the linking member cannot be achieved, the builder is often unable to fabricate a structure which, for instance, will sit on a plane surface. Such inability is engendered by the inaccuracy with which the sockets of the linking members are formed, typically by molding or drilling. Manifestly, any inaccuracies are magnified by reason of the length of the struts. Thus, where it is desired with prior sets, for instance, to formulate a cube structure and the angles of the linking members are inaccuractely formed, the free ends of the struts may not lie in a common plane, may diverge or converge, with the result that the free ends of the struts may be interconnected with other struts and linking members only by physically distorting the struts, with resultant warping and possible breakage.

By utilizing an elastic connector member which nonetheless forms a strong frictional connection with the struts, many of the shortcomings of construction toy units heretofore known are overcome. Specifically, a significant advantage of the present device lies in the fact that the structural shapes are dictated principally by the dimensions of the struts, e.g. length, a factor which is easily controlled, rather than by the angular relation of the sockets and the connectors.

It will be apparent to those skilled in the art that the invention as herein described is susceptible of numerous modifications in the light of the disclosure. Accordingly, the invention is to be broadly construed within the scope of the appended claims.

Having thus described the invention and illustrated its use, what is claimed as new and is desired to be secured by Letters Patent is:

1. A construction toy device for the formation of three dimensional configurations based upon interlocked equilateral triangles comprising at least six elongated, rigid strut members of equal length and a plurality of elastic linking members adapted to receive and frictionally retain end portions of said strut members, said linking members being of generally spherical shape and including a plurality of angularly spaced-apart, radially directed frictional support sockets extending from the surface at least part way toward the center thereof, and sized yieldingly and frictionally to retain end portions of said struts while permitting a degree of angular bodily movement of said struts, said sockets including and being located as follows:

a. a first series of six said sockets lying on the equator of said sphere, the sockets of said first series being equally spaced apart along said equator an angular distance of about 60°;

b. second and third series of six sockets each, the sockets of said second and said third series being arrayed between said equator and the North and South poles of said sphere, respectively, the sockets of said second and third series lying on small circles of said sphere, the planes of said small circles being parallel to said equator, said sockets of said second and third series being equally spaced apart on their respective small circles, each socket of said second and third series being angularly offset at an angle of about 60° from two adjacent sockets of said first series.

2. A toy device in accordance with claim 1 wherein said linking members include, in addition a polar said socket at each of said North and South poles.

3. A toy device in accordance with claim 2 wherein said linking member includes a fourth series comprising six said sockets, each socket of said fourth series being located on said equator half way betwen each adjacent pair of sockets of said first series.

4. A toy device in accordance with claim 3 wherein the surface of said sphere includes indicia means for enabling the said polar sockets and the sockets of said fourth series to be distinguished from the sockets of said first, second and third series.

5. A toy device in accordance with claim 1 wherein said linking members comprise a cellular material.

6. A toy device in accordance with claim 5 wherein said linking members comprise sponge rubber.

7. A construction toy device for the formation of three dimensional configurations based on interlocked equilateral triangles, said device including at least six elongated struts and at least four linking members, said linking members being characterized by being comprised of sponge rubber spheres having formed therein a plurality of radially directed friction support sockets adapted yieldingly to receive and frictionally to retain end portions of said struts while permitting a degree of angular movement of said struts relative to said linking members, responsive to deformation of said linking members.

8. A device in accordance with claim 7 wherein said support sockets are located relative to said linking members in such manner as to provide a plurality of groups of sockets, the sockets of each group being angularly related to each other by 60°.

* * * * *